US005090377A

United States Patent [19]

Pearson

[11] Patent Number: 5,090,377

[45] Date of Patent: Feb. 25, 1992

[54] RECHARGEABLE FUEL INJECTION KIT

[75] Inventor: Burton A. Pearson, Taylor, Mich.

[73] Assignee: Shrader Canada Limited, Oakville, Canada

[21] Appl. No.: 670,695

[22] Filed: Mar. 18, 1991

[51] Int. Cl.[5] ..... F02B 77/04

[52] U.S. Cl. ..... 123/198 A; 134/169 A

[58] Field of Search ..... 123/1 A, 198 A; 134/20, 134/22.1, 22.11, 22.19, 169 R, 169 A

[56] References Cited

U.S. PATENT DOCUMENTS

| | | | |
|---|---|---|---|
| 1,749,312 | 3/1930 | Blair | 123/198 A |
| 3,945,366 | 3/1976 | Matthews | 123/198 A |
| 4,346,689 | 8/1982 | Neely | 123/198 A |
| 4,377,135 | 3/1983 | Abthoff et al. | 123/198 A |
| 4,512,587 | 4/1985 | Burke et al. | 277/205 |
| 4,520,773 | 6/1985 | Koslow | 123/198 A |
| 4,606,311 | 8/1986 | Reyes et al. | 123/198 A |
| 4,784,170 | 11/1988 | Romanelli et al. | 123/198 A |
| 4,807,578 | 2/1989 | Adams et al. | 123/198 A |
| 4,920,996 | 5/1990 | Flanner | 134/22.11 |

OTHER PUBLICATIONS

"The TUNAP Automobile Service Program", General Survey, pp. 1-2, no date.

"Care, Maintenance and Repair Products", LM Liquimoly, pp. 1-2, no date.

"Neuartige Chemische Werkzeuge fur den Werkstatt--einsatz", by Dietrich W. Putz, pp. 1-6, 1984.

"Inject-A-Flush", Fuel System Injector Cleaning Kit, pp. 1-2, 1988.

"Clean with Inject-A-Kleen", Petro Chemical, pp. 1-4, 1985.

*Primary Examiner*—Noah P. Kamen

*Attorney, Agent, or Firm*—Bell, Seltzer, Park & Gibson

[57] ABSTRACT

A fuel injection system cleaning kit includes a pressurizable container of cleaning fluid, and a regulator to control the discharge pressure of the cleaning fluid. An isolating valve is located in the conduit between the regulator and container and a charging valve is placed between the container and isolating valve. With the isolating valve closed, a pressurized gas such as air, can charge the container through the charge valve.

5 Claims, 1 Drawing Sheet

RECHARGEABLE FUEL INJECTION KIT

BACKGROUND OF THE INVENTION

The present invention relates to a fuel injection system cleaning kits.

The use of fuel injection systems or an increasing number of automobiles has resulted in a number of kits to permit cleaning and maintenance of the systems. These kits conventionally use a cleaning fluid that may also be used as a fuel so that the engine will continue to operate as the cleaning fluid passes through the system.

Typical of such kits are those available from BG since about 1985 and sold in Europe by Tune-Ap Deutschland Vertriebs GmbH Co. of Wolfratshausen, Germany under the name Tune-Ap since about 1981. Each of these kits includes a pressurized container of cleaning fluid which is connected through a regulator and appropriate fitting to the injection system. As the fluid is used, the system is cleaned and when all the fluid is used the engine will stall, indicating that the cleaning process is complete. The kit may then be reused on another vehicle with a new container of fluid.

Whilst this arrangement is satisfactory and convenient for the majority of applications, some injection systems utilize higher operating pressures than can be sustained from pressurized containers for the necessary time. This is in part because a limit is placed on the charge pressure of the containers when they are to be transported.

Typically, the maximum charge pressure permitted is 130 psi but some systems require operating pressures as high as 75 psi. This means that the pressure available from the container will fall below the system pressure before all the cleaning fluid is used.

It has also been found in some instances that the container has not been charged fully and so once again all the cleaning fluid cannot be used. In both instances, the user of the kit is frustrated and the partially used container poses a disposal problem given the flammable nature of the container that cannot be resealed.

It is therefore an object of the invention to obviate or mitigate the above disadvantages.

SUMMARY OF THE INVENTION

In general terms, a kit is provided that includes a charging valve and an isolating valve between the container and the regulator. The charging valve may be connected to a source of pressurized gas such as air so that after the isolating valve is closed, the container may be charged to the desired level. The charging valve is preferably a check valve that prevents reverse flow through the valve once the source is disconnected.

In this way, the container may be transported within the maximum pressure limits imposed and may be charged as the need arises to ensure all the fluid is utilised.

An embodiment of the invention will now be described by way of example only with reference to the accompanying drawings in which

DESCRIPTION OF THE PREFERRED EMBODIMENTS

Figure 1:
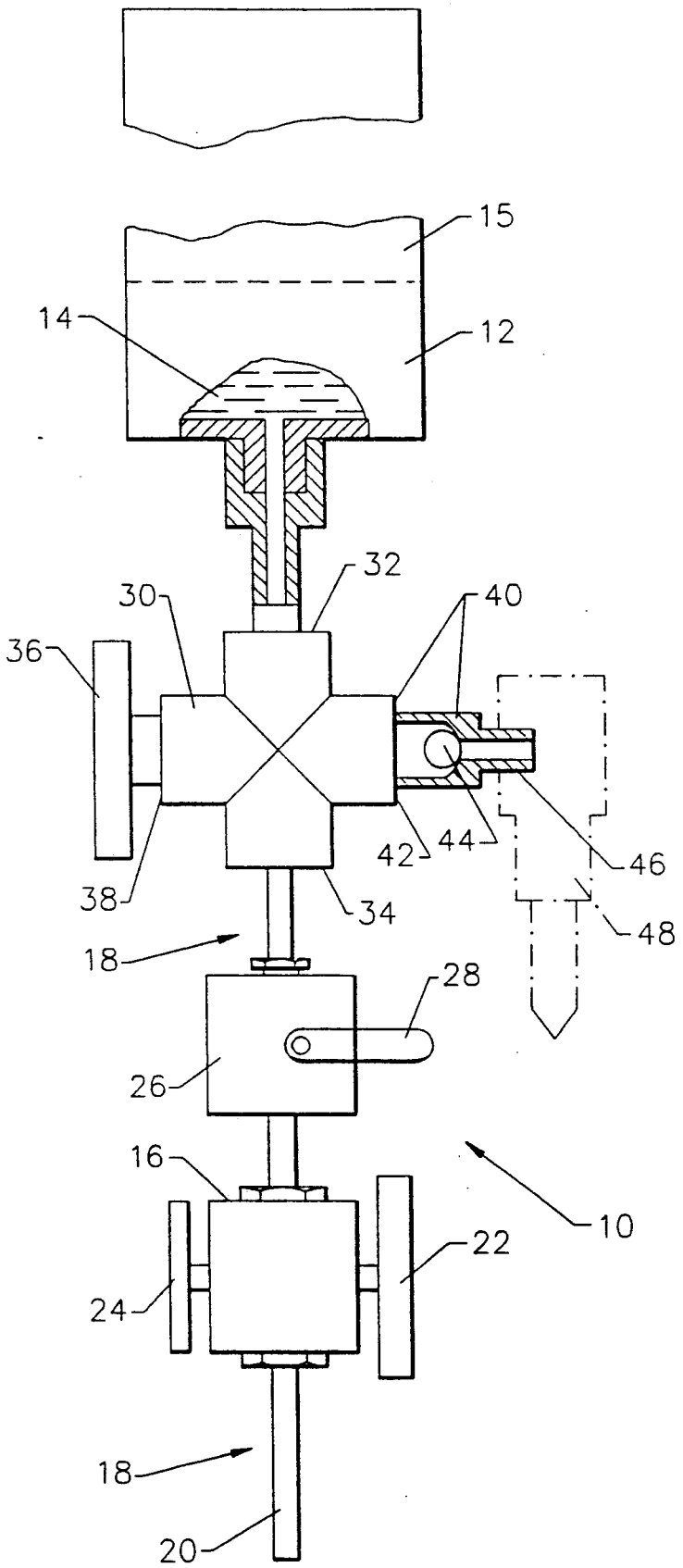
FIG. 1 is a schematic representation of a kit in an assembled condition.

A fuel injection kit 10 includes a container 12 with cleaning fluid 14 and a pressured gaseous propellant 15, a regulator 16 and a conduit 18 to connect the container 12 and regulator 16. The container 12 and fluid 14 are available as precharged units from a variety of sources such as Shrader Canada under the trade name. An adapter 20 is connected between the regulator 16 and the fuel injection system (not shown). The adapter 20 may be several fittings supplied with the kit 10 to allow connection to one of several injection systems as is well known, and should also include a flexible portion to allow inversion of container 12 in use.

The regulator 16 is adjustable by control 22 to adjust the pressure delivered to the adapter 20. The actual pressure delivered is monitored by a pressure gauge 24 so that the output pressure can be adjusted to suit different fuel injection systems.

Conduit 18 includes an isolating valve 26 with a manual control 28 that allows the valve 28 to be either open or closed. Located between the valve 26 and container 12 is a 4 way fitting 30. Container 12 is connected to one of the outlets 32 and isolating valve 26 to the opposite outlet 34. A pressure gauge 36 is connected to the third outlet 38 and a charging valve 40 to the fourth outlet 42.

Charging valve 40 includes a check valve 44 that operates to allow flow into conduit 18 but prevents flow in the opposite direction. The valve 40 includes a boss 46 that allows connection of a pressurized air line, indicated in ghosted outline at 48. In practice, check valve 44 is conveniently a tire valve that is formed with boss 46 and is compatible with the air line 48.

In operation, the kit 10 is assembled as shown and the adapter 20 connected into the fuel injection system after the conventional supply pump is rendered inoperable. The connection of the canister 12 to the outlet 32 punctures the seal on the canister, again in known manner so that the pressurized contents can communicate with the conduit 18.

Valve 26 is opened and the regulator 16 adjusted so that the correct pressure is delivered to the system. The canister 12 is inverted so that the fluid 14 is discharged to the conduit 18, and the engine started. The cleaning fluid will supply fuel to the engine during cleaning and the gauge 24 monitored to ensure that the correct delivery pressure is being used.

Once all the fluid 14 has been discharged, the engine will stall and the cleaning is complete. During normal operation, charge valve 40 remains closed. If however, insufficient pressure is available to discharge the fluid 14, the canister may be charged utilising valve 40. Isolating valve 26 is closed and the air hose 48 attached to boss 46. The canister is positioned so that fluid 14 is away from the outlet 32 and air charged into container 12 through check valve 44. Valve 26 prevents the air escaping through regulator 16 and gauge 36 can be used to monitor the pressure within the container 12. Typical air supply lines 48 will not have sufficient pressure to damage the canister 12 but if this is a concern, a relief valve can be substituted for or incorporated in the gauge 36. Once the canister 12 is charged, the hose 48 may be disconnected and the kit 10 used to complete the cleaning process.

It will be seen therefore that the disadvantages associated with the art have been overcome in a simple yet effective manner. While the container 12 has been described as a precharged container 12, it will be apparent that container 12 need not be precharged but could in fact be charged in situ which cleaning fluid 14 could be added on each occasion.

We claim:

1. A fuel injection cleaning kit comprising a pressurizable container of cleaning fluid, a regulator to regulate the pressure of fluid discharged from said container, conduit means to connect said container and said regulator, said conduit means including an isolating valve operable to prevent flow between said container and said regulator and a charging valve to be located between said container and said isolating valve, said charging valve permitting flow into said container from a pressurized source connected thereto and inhibiting flow in the opposite direction.

2. A fuel injection cleaning kit according to claim 1 wherein said regulator is adjustable.

3. A fuel injection cleaning kit according to claim 2 wherein said regulator includes a pressure gauge to indicate the pressure of fluid delivered by said regulator.

4. A fuel injection cleaning kit according to claim 1 wherein a pressure gauge is located in said conduit between said container and said isolating valve.

5. A fuel injection cleaning kit according to claim 1 wherein said charging valve is a check valve configured to permit connection of an air supply thereto.

* * * * *